US008662610B2

(12) United States Patent
Saga et al.

(10) Patent No.: US 8,662,610 B2
(45) Date of Patent: Mar. 4, 2014

(54) PRESSURE DAMPER, LIQUID JET HEAD, AND LIQUID JET APPARATUS

(75) Inventors: Yukihiro Saga, Chiba (JP); Toshiaki Watanabe, Chiba (JP)

(73) Assignee: SII Printek Inc. (JP)

( * ) Notice: Subject to any disclaimer, the term of this patent is extended or adjusted under 35 U.S.C. 154(b) by 442 days.

(21) Appl. No.: 12/931,947

(22) Filed: Feb. 15, 2011

(65) Prior Publication Data

US 2011/0205315 A1 Aug. 25, 2011

(30) Foreign Application Priority Data

Feb. 25, 2010 (JP) ..... 2010-041058

(51) Int. Cl.
*B41J 2/195* (2006.01)
*B41J 29/393* (2006.01)
*B41J 2/175* (2006.01)

(52) U.S. Cl.
USPC ..... 347/7; 347/19; 347/85

(58) Field of Classification Search
USPC ..... 347/7, 19, 85
See application file for complete search history.

(56) References Cited

U.S. PATENT DOCUMENTS

| | | | | |
|---|---|---|---|---|
| 5,992,990 | A | 11/1999 | Childers et al. | 347/87 |
| 2006/0007254 | A1 | 1/2006 | Tanno et al. | 347/7 |
| 2007/0188529 | A1 | 8/2007 | Zhang | 347/7 |
| 2008/0198207 | A1 | 8/2008 | Katada | 347/85 |
| 2009/0174734 | A1 | 7/2009 | Wanibe | 347/7 |

FOREIGN PATENT DOCUMENTS

| | | |
|---|---|---|
| EP | 2050572 | 4/2009 |
| WO | 98 55322 | 12/1998 |

OTHER PUBLICATIONS

Patent Abstracts of Japan, publication No. 2005-231351, publication date Sep. 2, 2005.

*Primary Examiner* — Jannelle M Lebron
(74) *Attorney, Agent, or Firm* — Adams & Wilks

(57) ABSTRACT

A pressure damper includes a main body portion having a recessed portion with an opening and a communication hole that opens to an inner surface of the recessed portion and communicates to an external region. A flexible thin film closes the opening of the main body portion for reducing pressure fluctuations of fluid in the recessed portion. A detecting portion is engaged with the main body portion for detecting electromotive force generated by electromagnetic induction to thereby detect a relative positional change between the flexible thin film and the main body portion.

23 Claims, 9 Drawing Sheets

PRESSURE DAMPER, LIQUID JET HEAD, AND LIQUID JET APPARATUS

BACKGROUND OF THE INVENTION

1. Field of the Invention

The present invention relates to a pressure damper for reducing pressure fluctuations of fluid, and more particularly, to a pressure damper having a function of converting pressure fluctuations of fluid into an electrical signal, and a liquid jet head and a liquid jet apparatus using the same.

2. Description of the Related Art

In recent years, there has been used an ink jet type liquid jet head for discharging ink droplets on recording paper or the like to print a character or graphics on the recording paper or for discharging a liquid material on a surface of an element substrate to form a functional thin film. In such a liquid jet head, ink or a liquid material is supplied from a liquid tank via a supply tube to the liquid jet head, and the ink or the liquid material filled into a channel is discharged from a nozzle which communicates to the channel. When the ink is discharged, the liquid jet head or a recording medium on which jetted liquid is to be recorded is moved to print the character or the graphics on the recording paper, or, to form a functional thin film in a predetermined shape. In this kind of device, it is necessary to control with high precision the amount of a liquid droplet discharged from a nozzle and a discharge speed. Therefore, it is necessary to control with high precision the pressure of ink in a discharge plane of the nozzle.

For example, Japanese Patent Application Laid-open No. 2005-231351 describes an ink jet recording apparatus including a regulating structure of the pressure of liquid which is discharged from a print head. The ink jet recording apparatus includes a main tank for storing ink, a sub-tank for receiving ink supply from the main tank and supplying the ink to an ink jet head, a pump for regulating an internal pressure of the sub-tank, and a pressure gauge placed for ink supply. In the ink jet recording apparatus, by regulating the internal pressure of the sub-tank according to status of usage, an internal pressure of ink is controlled. For example, when highly viscous ink is discharged, or auxiliary discharge is used for letting out air bubbles, negative pressure on ink is controlled to be lower than that when printing is carried out.

However, in the ink jet recording apparatus described in Japanese Patent Application Laid-open No. 2005-231351, the pressure gage is connected to a tube which is branched from a part of a liquid supply path. Thus, liquid which passes through the liquid supply path may enter the pressure gage side. The liquid jet head reciprocates at high speed. In particular, when the direction of movement of the liquid jet head is reversed or when the liquid jet head undergoes rapid acceleration, due to inertia of liquid in a tube, the internal pressure fluctuates. The pressure fluctuations cause liquid to enter the pressure gauge, which in turn causes ink or liquid which enters the pressure gauge to thicken or solidify to lower detection precision of the pressure gauge. As a result, there are problems that, for example, pressure control of the ink or the liquid material becomes inadequate to thereby lower the recording quality.

SUMMARY OF THE INVENTION

In recent years, the liquid jet apparatus is becoming larger and the recording speed of this kind of apparatus is increasing. As the apparatus becomes larger, the length of a tube from a fixed liquid tank containing ink or the like to a moving liquid jet head becomes larger. Normally, in this kind of apparatus, in order to make the meniscus of liquid in a nozzle of the liquid jet head and a discharge speed of the liquid droplet discharged from the nozzle constant, an internal pressure of liquid in a discharge region is controlled. However, when the length of the tube becomes larger, the flow path resistance of liquid which flows therein increases and the pressure loss due to the flow path increases. Further, as a moving distance and a movement speed of the liquid jet head increases, fluctuations of the internal pressure due to the inertia of liquid increase. Therefore, it is necessary to control the internal pressure of liquid in the discharge region with higher precision, and further, it is necessary to enhance a damping function of reducing fluctuations of the internal pressure of liquid. The present invention has been made in view of the foregoing problems, and an object of the present invention is to reduce the pressure fluctuations of liquid and to detect the pressure fluctuations without being affected by the characteristics of the liquid.

In a first aspect, a pressure damper according to the present invention includes: a main body portion, the main body portion including a recessed portion with an opening and a communication hole which is open to an inner surface of the recessed portion and communicates to an external region; a flexible thin film which closes the opening for reducing pressure fluctuations of fluid included in the recessed portion which is closed; and a detecting portion engaged with the main body portion for detecting electromotive force generated by electromagnetic induction, thereby detecting relative positional change between the flexible thin film and the main body portion.

Further, the detecting portion includes a transmitter coil for generating magnetic lines of force and a receiver coil for inducing the electromotive force.

Further, the pressure damper further includes an elastic member one end of which is engaged with the flexible thin film and the other end of which is engaged with the main body portion.

Further, the pressure damper further includes a reference member engaged with the flexible thin film, the reference member comprising a conductive material or a magnetic material.

Further, the elastic member is connected between the reference member and the main body portion.

Further, the reference member and the elastic member are one integral member.

Further, the pressure damper further includes a position regulating portion for regulating a positional relationship between the reference member and the main body portion.

Further, the position regulating portion is placed between the elastic member and the main body portion.

Further, the pressure damper further includes: a cover placed on the main body portion so as to cover the flexible thin film, in which the detecting portion is placed on the flexible thin film side of the cover, and the detecting portion and the main body portion engage with each other via the cover.

Further, the transmitter coil and the receiver coil each have a planar shape, and are stacked so as to be concentric in plan view.

Further, an outer shape of the transmitter coil and an outer shape of the receiver coil are the same.

Further, the transmitter coil and the receiver coil each have a planar shape, and are stacked so as to partially overlap in plan view.

Further, the transmitter coil and the receiver coil each have a planar shape, and are formed so as not to overlap in plan view.

Further, the transmitter coil and the receiver coil each have a planar shape, and are parallel to each other, and an outer shape of the reference member is larger than the outer shapes of the transmitter coil and the receiver coil viewed from a direction of a normal to a plane of the flat shapes.

Further, the detecting portion includes an insulating substrate for mounting thereon the transmitter coil and the receiver coil.

Further, the detecting portion includes a magnetic layer having a high magnetic permeability which is placed on an opposite side of the flexible thin film with respect to the transmitter coil and the receiver coil.

Further, the detecting portion includes a transmitter circuit for transmitting to the transmitter coil a signal for detecting position and a receiver circuit for generating from a signal received by the receiver coil a detection signal representing the relative positional change.

Further, the receiver circuit includes an offset regulating portion for regulating an offset of a received signal and a gain regulating portion for regulating a gain in amplifying a received signal.

Further, the detecting portion includes a storing portion for storing set values of the offset and the gain.

In a second aspect, a liquid jet head according to the present invention includes: the pressure damper according to any one of the above-mentioned embodiments of the first aspect of the invention; a tube communicating to the communication hole of the pressure damper; and an actuator for causing liquid which flows in from the tube to be discharged.

In a third aspect, a liquid jet head according to the present invention includes: the liquid jet head according to the second aspect of the invention; a tank for storing the liquid and supplying the liquid to the tube; and a pump for controlling the pressure of the liquid based on the relative positional change detected by the pressure damper.

The pressure damper according to the present invention includes: a main body portion, the main body portion including a recessed portion with an opening and a communication hole which is open to an inner surface of the recessed portion and communicates to an external region; a flexible thin film which closes the opening for reducing pressure fluctuations of fluid enclosed in the recessed portion; and a detecting portion engaged with the main body portion for detecting electromotive force generated by electromagnetic induction thereby detecting relative positional change between the flexible thin film and the main body portion. By this construction, the pressure damper according to the present invention has an advantage that, when pressure fluctuations are caused in fluid enclosed in the recessed portion, the flexible thin film reduces the pressure fluctuations, and, based on the positional fluctuations of the flexible thin film, pressure fluctuations of fluid may be detected.

DETAILED DESCRIPTION OF THE PREFERRED EMBODIMENTS

Figure 1:
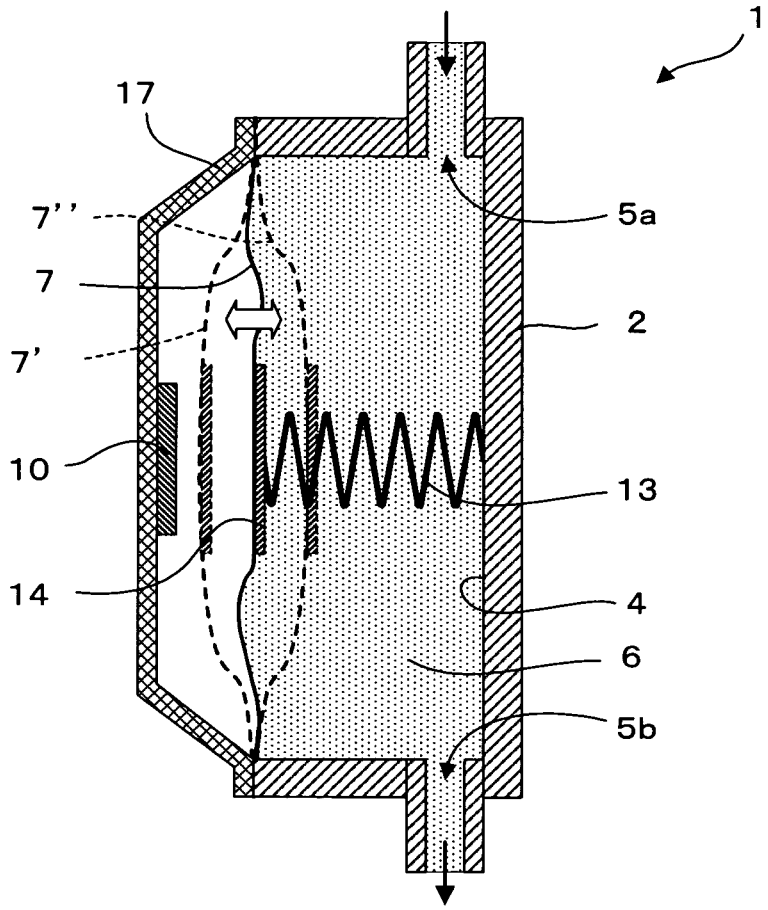
FIG. 1 is a schematic longitudinal sectional view of a pressure damper according to a first embodiment of the present invention.

A pressure damper according to the present invention includes a main body portion having a recessed portion, a flexible thin film which closes an opening of the recessed portion for reducing pressure fluctuations of fluid included in the enclosed recessed portion, and a detecting portion engaged with the main body portion for detecting electromotive force generated by electromagnetic induction, thereby detecting relative positional change between the flexible thin film and the main body portion. The main body portion includes, in an inner surface of the recessed portion, a communication hole for communicating to an external region. Fluid enclosed in the recessed portion communicates to fluid in the external region via the communication hole. For example, the pressure damper may include a plurality of communication holes one of which is a supply port of fluid and another one of which is a delivery port of fluid to form a part of a flow path, or the pressure damper may include only one communication hole to communicate with a tank for storing fluid and to a flow path through which fluid passes via the communication hole.

Note that, a state in which a member A and a member B engage with each other includes not only a state in which the member A and the member B are directly in contact with each other and fixed to each other but also a state in which the member A and the member B are fixed to each other via a member C and a state in which the member A and the member B are not fixed to each other but are mechanically engaged with each other, for example, a state in which the member A and the member B are not fixed to each other but the member A is urged to be in abutting contact with the member B. The same can be said with regard to the following description.

Specific description is made in the following. When the pressure of fluid in the external region fluctuates, the pressure of internal fluid in the recessed portion also fluctuates via the communication hole. The pressure fluctuations are reduced by flexure of the flexible thin film. The detecting portion detects positional change of the flexible thin film as change in the electromotive force on a secondary circuit side generated by electromagnetic induction. More specifically, the detecting portion sends alternating current to a transmitter coil on a primary side to generate a magnetic field, causes electromotive force to be generated at a receiver coil on a secondary side by electromagnetic induction, and detects the change in the electromotive force. The electromotive force changes according to positional change of the flexible thin film. The positional change of the flexible thin film is based on the pressure fluctuations of fluid in the recessed portion, and thus, as a result, the detecting portion detects the pressure fluctuations of fluid. In this case, the transmitter coil and the receiver coil may be placed on the detecting portion. This enables a compact structure of wiring and the like. Further, one of the transmitter coil and the receiver coil may be placed on the flexible thin film and the other may be placed on the detecting portion. This may improve the sensitivity of detection.

As the flexible thin film, a thin film made of a polymeric material, a conductive thin film, or a magnetic thin film may be used. For example, a metallic thin film or a magnetic thin film may be processed to be bellows-like, thereby forming the flexible thin film which is elastically deformable. Further, a conductive thin film or a magnetic thin film may be deposited on a flexible polymeric material to form the flexible thin film. Still further, by using an elastic body as the flexible thin film, resilience to return to an original shape may be given to the flexible thin film.

Further, a reference member made of a conductive material or a magnetic material may be engaged with the flexible thin film. When positional change of the flexible thin film is caused by pressure fluctuations of fluid in the recessed portion, positional change of the reference member also occurs. The positional change of the reference member changes the strength and the path of magnetic lines of force through the reference member. The change in the magnetic lines of force is detected as change in the electromotive force induced at the receiver coil to detect the pressure fluctuations in the recessed portion. As the conductive material, a metallic material may be used. As the magnetic material, an alloy containing a ferromagnetic element, an intermetallic compound, a magnetic sheet with powder of such an alloy or such an intermetallic compound mixed therein or the like may be used.

Further, the flexible thin film and an elastic member may be engaged with each other to give the flexible thin film the function of returning to the original shape. For example, one end of the elastic member is engaged with the flexible thin film while the other end of the elastic member is engaged with the main body portion so that the elastic member is placed between the flexible thin film and the main body portion. This may prevent the flexible thin film from, when the pressure in the recessed portion becomes negative, bending inward to close the communication hole and blocking communication of fluid. As the elastic member, a coil spring or a leaf spring may be used. When those springs are used, one end thereof may be fixed to a portion of the flexible thin film at which the flexure is the greatest, and the other end thereof may be fixed to a bottom surface or a side surface of the recessed portion of the main body portion. The flexible thin film changes its position almost as a free end in a direction of a normal to a surface of fluid, and thus, has the function of reducing pressure fluctuations when the pressure of fluid suddenly changes. Further, the position of the flexible thin film is a point at which the internal pressure of fluid, the outside atmospheric pressure, the resilience (stress) of the elastic member, and the like are in equilibrium, and thus, the pressure of fluid may be determined from the position.

Further, a position regulating portion may be provided, which engages the flexible thin film and the reference member with each other, for regulating the positional relationship between the reference member and the main body portion. For example, the reference member is fixed to one end of the elastic member, the reference member is engaged with the flexible thin film, and the position regulating portion is placed between the other end of the elastic member and the main body portion. This allows to correct positional variations of the reference member due to tolerances of members and the like. Further, when a cover is provided outside the flexible thin film as described in the following, a position regulating portion for regulating the positional relationship between the reference member and the cover may be provided. For example, it may be constructed such that the reference member is fixed to one end of the elastic member, the reference member is engaged with the flexible thin film, and the position regulating portion is placed between the other end of the elastic member and the cover. Further, when the flexible thin film itself is an elastic body, a position regulating portion for regulating the position of the flexible thin film may be provided between the flexible thin film and the main body portion.

Further, the cover may be placed so as to cover an outer surface of the flexible thin film. The cover provided on the outer surface side of the flexible thin film functions as a stopper when the pressure of fluid becomes excessively high and the flexible thin film bends outward, and may prevent the flexible thin film from being broken. Further, the detecting portion may be placed on the flexible thin film side of the cover. As a result, the transmitter coil and the receiver coil of the detecting portion may be placed close to the reference member or the flexible thin film, and thus, the sensitivity of position detection may be improved.

Further, the transmitter coil and the receiver coil may be a cylindrical coil, a flat coil, or a honeycomb coil. Both the transmitter coil and the receiver coil may be flat coils and the transmitter coil and the receiver coil may be stacked so as to be overlapped. This may make smaller the outer shape of the detecting portion. Further, the transmitter coil and the receiver coil may be formed in a same plane. This may make smaller the thickness of the detecting portion. Further, the transmitter coil and the receiver coil may be formed so as to partially overlap in plan view. As a result, the offset level of the electromotive force is to be detected by the ratio of the overlapped area of the coils.

Further, a magnetic layer having a high magnetic permeability may be placed between the transmitter coil and the receiver coil of the detecting portion and the cover. When metal is used as the cover, a loss due to eddy current is caused when a magnetic field passes through the metal to lower the sensitivity of detection. By placing a magnetic layer having a high magnetic permeability to be a magnetic path between the transmitter coil and the cover or between the receiver coil and the cover, the sensitivity of detection may be prevented from being lowered. For example, a magnetic layer is provided between the transmitter coil and a detection circuit or between the receiver coil and the detection circuit, and the magnetic layer on the detection circuit side is placed on the cover. Alternatively, the transmitter coil and the receiver coil, the detection circuit, and the magnetic layer are stacked in this order, and the magnetic layer is placed on the cover side. Further, the cover itself may be made of a magnetic material having a high magnetic permeability. This may reduce the loss due to eddy current which is caused when magnetic lines of force pass through the metal, and thus, the sensitivity of detection may be improved.

Further, by incorporating the above-mentioned pressure damper in a liquid jet head, pressure fluctuations of liquid close to the liquid jet head may be reduced, and in addition, the actual pressure fluctuations close to the liquid jet head may be detected. Therefore, by exerting feedback control of the pressure of liquid to be supplied to the liquid jet head, dynamic pressure when the head reciprocates may be controlled and pressure loss due to the liquid supply tube when the liquid jet head is used in a large-sized printer may be reduced or compensated for. Further, by using flat coils as the transmitter coil and the receiver coil, a thin pressure damper may be formed, and thus, the liquid jet head having the pressure damper incorporated therein may be thin and compact as a whole. Further, in a liquid jet apparatus using the liquid jet head, the actual pressure fluctuations close to a jetting nozzle may be fed back to a pump for supplying liquid to control the pressure of liquid to be supplied to the liquid jet head with higher precision. In the following, the present invention is described in detail with reference to the attached drawings.

(First Embodiment)

FIG. 1 is a schematic longitudinal sectional view of a pressure damper 1 according to a first embodiment of the present invention. The pressure damper 1 includes a main body portion 2 having a recessed portion 4 for keeping fluid therein and a communication hole 5*a* and a communication hole 5*b* which are open in an inner wall surface of the recessed portion 4, a flexible thin film 7 which closes an opening of the main body portion 2 and which is flexible, a cover 17 placed on the main body portion 2 so as to cover an outer surface of the flexible thin film 7, a reference member 14 engaged with the recessed portion 4 side of the flexible thin film 7, an elastic member 13 one end of which is engaged with the reference member 14 and the other end of which is engaged with a bottom surface of the recessed portion 4, and a detecting portion 10 placed on the flexible thin film 7 side of the cover 17.

The recessed portion 4 enclosed by the flexible thin film 7 includes fluid 6 therein. The fluid 6 communicates to fluid in an external region via the communication holes 5*a* and 5*b*. More specifically, fluid is supplied from an external region via the communication hole 5*a* and is delivered to another external region via the communication hole 5*b*. For example, when pressure fluctuations are caused in fluid in the external region which communicates to the recessed portion 4 via the communication hole 5*a*, the pressure fluctuations propagate to inside the recessed portion 4 to displace the flexible thin film 7. When the flexible thin film 7 is displaced as illustrated by the arrow, the reference member 14 is also displaced. For example, when the pressure of fluid changes in a positive direction, the flexible thin film 7 is displaced to be a flexible thin film 7'. When the pressure of fluid changes in a negative direction, the flexible thin film 7 is displaced to be a flexible thin film 7". As a result, almost no pressure fluctuations propagate to fluid in the external region which communicates to the recessed portion 4 via the communication hole 5*b*.

The detecting portion 10 includes a transmitter coil, a receiver coil, and a detection circuit. Alternating current is applied to the transmitter coil to generate a magnetic field, and electromotive force generated by electromagnetic induction is induced at the receiver coil on a secondary side. As the reference member 14, a conductive material such as aluminum or a stainless steel may be used. If a conductive material is used, a loss is caused when magnetic lines of force pass through the conductive material, and the extent of the loss depends on the distance between the transmitter coil and the receiver coil and the reference member 14. Further, if a magnetic material having a high magnetic permeability is used as the reference member 14, the path of magnetic lines of force is changed by the magnetic material, and the extent of the change depends on the distance between the transmitter coil and the receiver coil and the reference member 14. The amount of the loss or the change in the path of the magnetic lines of force is detected by measuring the electromotive force induced at the receiver coil on the secondary side. In this way, pressure fluctuations in fluid may be detected from positional fluctuations of the reference member 14.

The fluid may be liquid and may be gas. As the elastic member 13, a coil spring may be used as illustrated in FIG. 1. Further, instead of a coil spring, a leaf spring or other elastic body members may be used. The flexible thin film 7 and the reference member 14 may be engaged with each other by bringing the reference member 14 into abutting contact with the flexible thin film 7 using urging force of the elastic member 13, or, by fixing the flexible thin film 7 to the reference member 14 using an adhesive or the like. Further, instead of the plurality of communication holes 5*a* and 5*b*, a single communication hole may be used, or still more communication holes may be used. Further, the reference member 14 may be provided on the cover 17 side of the flexible thin film 7. Further, the elastic member 13 may be engaged between the cover 17 and the flexible thin film 7, and the detecting portion 10 may be placed on the bottom surface of the recessed portion 4.

Figure 2A:
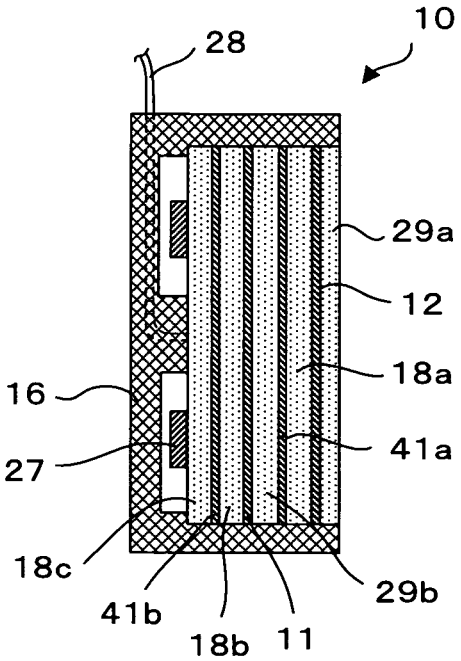
FIGS. 2A and 2B are explanatory diagrams of a detecting portion of the pressure damper according to the first embodiment of the present invention.
Figure 2B:
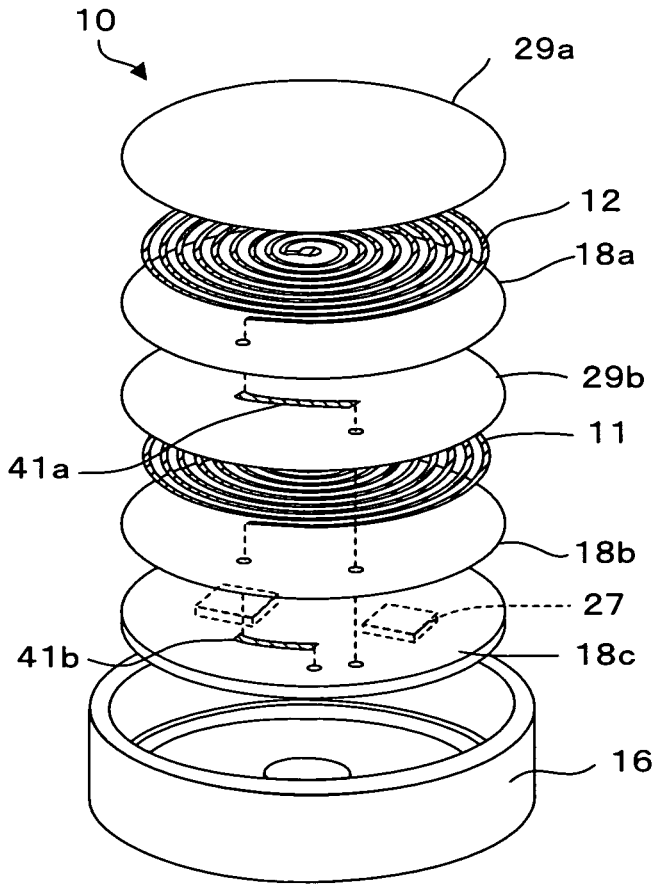

FIGS. 2A and 2B are explanatory diagrams of the detecting portion 10 described above. FIG. 2A is a schematic longitudinal sectional view of the detecting portion 10 while FIG. 2B is a schematic exploded perspective view of the detecting portion 10. Like reference symbols are used to designate like members or members having like functions.

As illustrated in FIGS. 2A and 2B, the detecting portion 10 includes a transmitter coil 11 for generating magnetic lines of force, a receiver coil 12 for inducing electromotive force, and a case 16 for housing the transmitter coil 11 and the receiver coil 12. More specifically, an insulating substrate 18*c* has, on a rear surface side thereof, a circuit element 27, and has, on a front surface side thereof, a stacked structure including an electrode (or wiring pattern) 41*b*, an insulating substrate (or insulating layer) 18*b*, the flat spiral transmitter coil 11, an insulating film 29*b*, an electrode (or wiring pattern) 41*a*, an insulating substrate (or insulating layer) 18*a*, the flat spiral receiver coil 12, and an insulating film 29*a*. Further, a lead 28 which pierces the case 16 is placed for connection to an external control portion. The stacked structure in this way may make smaller the thickness of the detecting portion 10.

Further, as a modification of the above, the detecting portion 10 may include the insulating substrate 18*a* having the receiver coil 12 mounted thereon, the insulating substrate 18*b* having the transmitter coil 11 mounted thereon, the insulating substrate 18*c* having the circuit element 27 mounted thereon, and the case 16 for housing them. The flat spiral receiver coil 12 is formed on an upper surface of the insulating substrate 18*a*, the insulating film 29*a* for protection is stacked on an upper surface of the flat spiral receiver coil 12, and the wiring electrode 41*a* which pierces the insulating substrate 18*a* for connection to the receiver coil 12 is formed on a rear surface of the insulating substrate 18*a*. Similarly, the flat spiral transmitter coil 11 is formed on an upper surface of the insulating substrate 18*b*, the insulating film 29*b* for protection is stacked on an upper surface of the flat spiral transmitter coil 11, and the wiring electrode 41*b* which pierces the insulating substrate 18*b* for connection to the transmitter coil 11 is formed on a rear surface of the insulating substrate 18*b*. The circuit element 27 which forms a transmitter circuit and a receiver circuit is placed on a rear surface of the insulating substrate 18*c*, and is electrically connected to the transmitter coil 11 and the receiver coil 12 via wiring which pierces the insulating substrate 18*c*. As a result, form a stacked structure easily.

As described above, the receiver coil 12 and the transmitter coil 11 are placed to be stacked so that the centers thereof coincide with each other in plan view, and thus, the outer shape of the detecting portion 10 may be made smaller. Further, the receiver coil 12 and the transmitter coil 11 are flat coils, and thus, the thickness of the detecting portion 10 may be made small. Still further, as the case 16, a magnetic material having a high magnetic permeability may be used. If a magnetic material having a high magnetic permeability is used, magnetic lines of force do not leak to the outside, and thus, the sensitivity of detection may be prevented from being lowered when a conductive material such as a metal is used as the cover 17.

Figure 3:
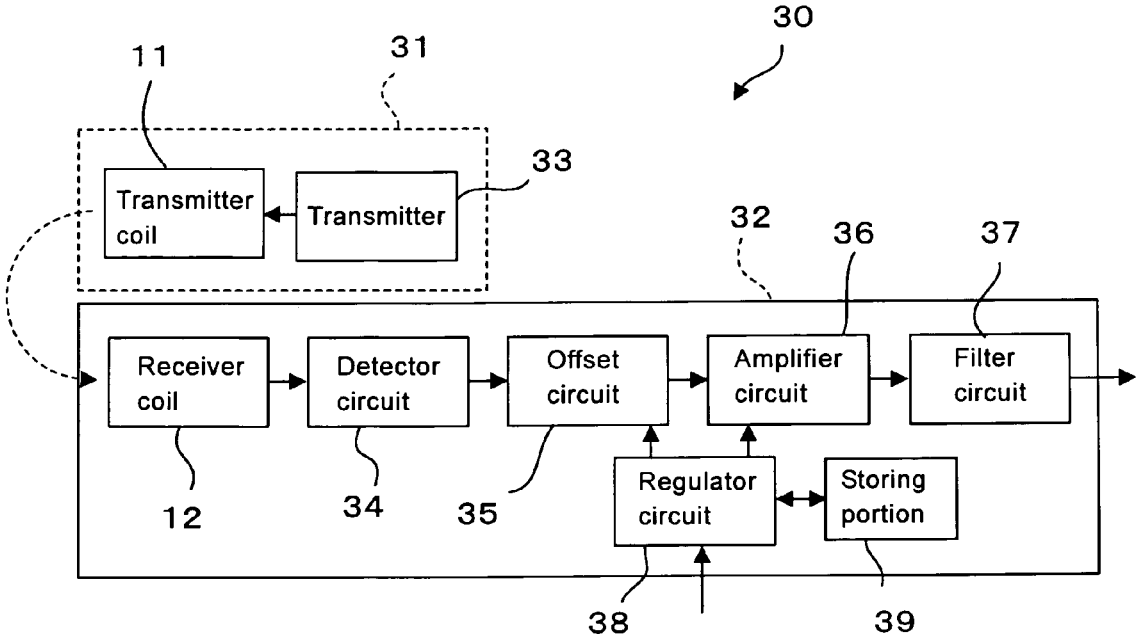
FIG. 3 is a block diagram of circuits of the detecting portion of the pressure damper according to the first embodiment of the present invention.

FIG. 3 is a block diagram of a detection circuit 30 in the detecting portion 10 described above. The detection circuit 30 includes a transmitter circuit 31 and a receiver circuit 32. The transmitter circuit 31 includes a transmitter 33 and the transmitter coil 11 for generating a magnetic field with alternating current which is input from the transmitter 33. The receiver circuit 32 includes the receiver coil 12 for inducing electromotive force by a magnetic field, detector circuit 34 for detecting induced electromotive force, an offset circuit 35 for setting an offset of a detected received signal, an amplifier circuit 36 for amplifying a received signal, a filter circuit 37 for filtering out noise components from an amplified received signal, a regulator circuit 38 for regulating an offset value and a gain, and a storing portion 39 for storing set values for setting the offset value and the gain.

The transmitter circuit 31 generates a magnetic field of a predetermined strength. The receiver circuit 32 generates induced electromotive force by the magnetic field generated by the transmitter coil 11, and detects positional change of the reference member 14 based on change in the induced electromotive force. More specifically, when the reference member 14 is a conductive material, eddy current is generated by magnetic lines of force which pass through the reference member 14 and a loss is caused. When the reference member 14 is a magnetic material, the path of magnetic lines of force which pass through the reference member 14 is changed. The loss of the magnetic lines of force and the change in the path depend on the distance between the coils and the reference member 14, and thus, if the relationship between the induced electromotive force and the distance is determined in advance, the position of the reference member 14 may be determined by the magnitude of the induced electromotive force. Similarly, if the relationship between the position of the reference member 14 and the internal pressure of the fluid 6 is determined in advance, the pressure of the fluid 6 may be determined by the magnitude of the induced electromotive force. The detection circuit 30 outputs the result of the detection of the positional displacement of the reference member 14 from the filter circuit 37 as a detection signal.

Here, the regulator circuit 38 may set the offset value of the offset circuit 35 and the gain of the amplifier circuit 36 based on setting data which is input from the external control portion. More specifically, when setting data is input from the outside, the regulator circuit 38 reads out from the storing portion 39 a set value which corresponds to the setting data, and sets the offset value of the offset circuit 35 and the gain of the amplifier circuit 36. Asa result, the detection characteristics may be arbitrarily set. Further, even if the shape and the quality of a material of a component which forms the pressure damper 1 vary, by regulation with regard to the individual piece, variations in the detection characteristics is allowed to fall within a predetermined range.

(Second Embodiment)

Figure 4:
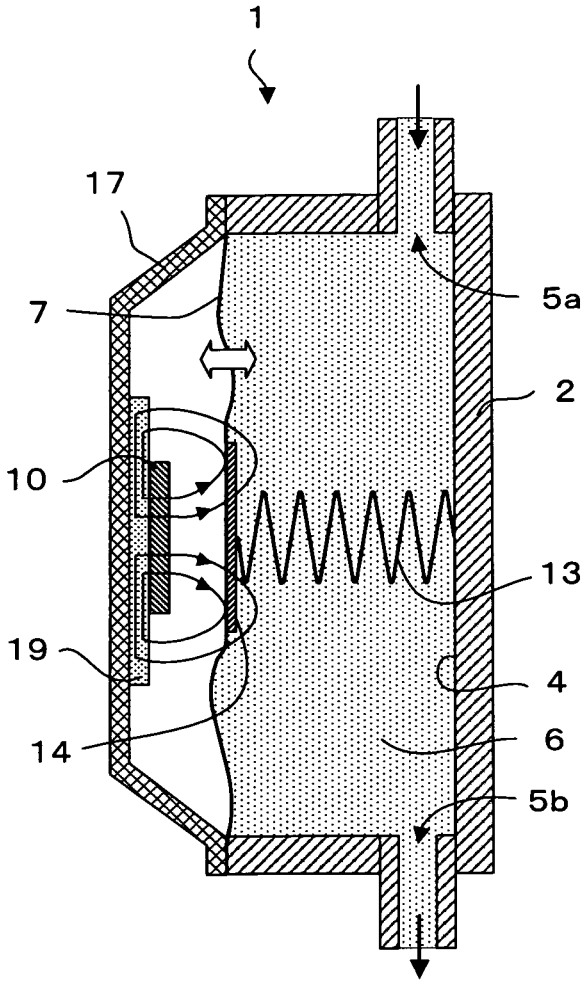
FIG. 4 is a schematic longitudinal sectional view of a pressure damper according to a second embodiment of the present invention.

FIG. 4 is a schematic longitudinal sectional view of the pressure damper 1 according to a second embodiment of the present invention. The second embodiment differs from the first embodiment in that a magnetic sheet 19 is provided between the cover 17 and the detecting portion 10, and other structures are similar to those in the first embodiment. Therefore, in the following, the different structure is described in the following and description of similar structures is omitted. Note that, like reference symbols are used to designate like members or members having like functions.

As illustrated in FIG. 4, the magnetic sheet 19 which is to be a magnetic path is placed between the cover 17 and the detecting portion 10. This prevents magnetic lines of force generated by the detecting portion 10 from reaching the cover 17, and the magnetic lines of force pass through the magnetic sheet 19. Even if a conductive metallic material is used as the cover 17, a loss due to eddy current is not caused, and thus, the sensitivity of detection may be prevented from being lowered.

Note that, instead of placing the magnetic sheet 19, a magnetic material having a high magnetic permeability may be used as the cover 17. Further, by placing the magnetic sheet 19 between the transmitter coil 11 and the detection circuit 30 or between the receiver coil 12 and the detection circuit 30 instead of placing the magnetic sheet 19 between the cover 17 and the detecting portion 10, similar effects may be obtained. Further, in order to prevent magnetic lines of force from leaking to the cover 17 side, it is desirable that the outer shape in plan view of the magnetic sheet 19 be larger than the outer shapes in plan view of the transmitter coil 11 and of the receiver coil 12. When a metallic material is used as the reference member 14, a shape thereof in cross section which is orthogonal to a central axis of the flat coils (transmitter coil 11 and receiver coil 12) is made larger than the outer shapes of the flat coils in plan view. This makes larger the loss due to eddy current, which makes larger the amount of change in the electromotive force induced at the receiver coil 12.

(Third Embodiment)

Figure 5:
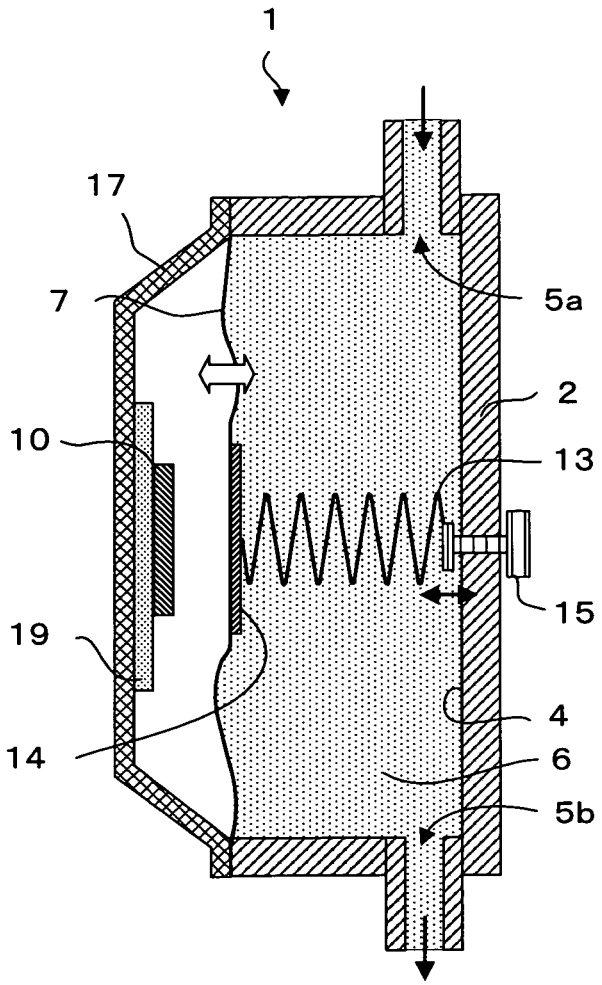
FIG. 5 is a schematic longitudinal sectional view of a pressure damper according to a third embodiment of the present invention.

FIG. 5 is a schematic sectional view of the pressure damper 1 according to a third embodiment of the present invention. The third embodiment differs from the first and second embodiments in that a position regulating portion 15 for regulating the position of the other end of the elastic member 13 is provided between the other end of the elastic member 13 and the main body portion 2, and other structures are similar to those in the second embodiment.

As the elastic member 13, a coil spring is used. The screw-in position regulating portion 15 is provided between the coil spring and the main body portion 2. As a result, the position of the reference member 14 is regulated according to the kind, the viscosity, and the internal pressure of the fluid 6, or according to tolerances of the elastic member 13, the reference member 14, the flexible thin film 7, the main body portion 2, and the like. Note that, the position regulating portion 15 illustrated in FIG. 5 is only exemplary and it goes without saying that other regulating structure may also be adapted.

Note that, in the first to third embodiments described above, the transmitter coil 11, the receiver coil 12, and the detection circuit 30 are integrally formed, but the present invention is not limited thereto. For example, one of the transmitter coil 11 and the receiver coil 12 may be formed on a surface of the flexible thin film 7, especially on a surface of the flexible thin film which is opposite to the fluid 6 side, while the other of the transmitter coil 11 and the receiver coil 12 may be placed on the cover 17 or the main body portion 2 so as to be integral with the detection circuit 30.

FIGS. 6A to D are explanatory diagrams illustrating arrangements of the transmitter coil 11 and the receiver coil 12 of the pressure damper 1 according to fourth to seventh embodiments of the present invention.

(Fourth Embodiment)

Figure 6A:
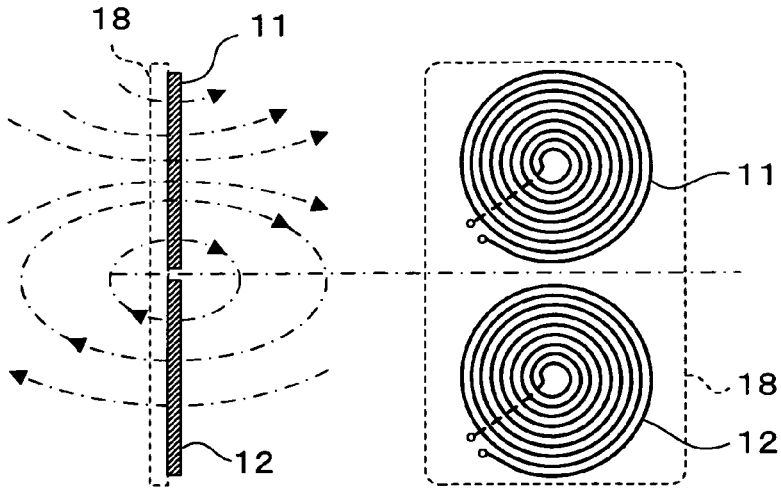
FIGS. 6A to 6D are explanatory diagrams of a transmitter coil and a receiver coil of pressure dampers according to fourth to seventh embodiments of the present invention.

FIG. 6A illustrates a state in which the transmitter coil 11 and the receiver coil 12 are formed on a same surface of one insulating substrate 18. The figure on the left is a schematic sectional view while the figure on the right is a schematic plan view. A metal film is formed on the surface of the insulating substrate 18, and then photolithography and etching are carried out to form the flat spiral coils. Terminals on a center side of the transmitter coil 11 and the receiver coil 12 are routed to a rear surface side via through holes provided in the insulating substrate 18.

When alternating current passes through the transmitter coil 11, magnetic lines of force are generated, which are linked with the transmitter coil 11 according to a winding number of the transmitter coil 11. A part of the magnetic lines of force is linked with the receiver coil 12 to induce electromotive force at the receiver coil 12. Such a structure eliminates the necessity to stack the transmitter coil 11 and the receiver coil 12, and thus, the thickness of the detecting portion 10 may be made small. Further, by incorporating the detection circuit 30 in the insulating substrate 18, the number of parts may be decreased and the man-hours necessary for the assembly may be reduced. Note that, the outer shape of one of the transmitter coil 11 and the receiver coil 12 may be formed so as to be larger than the outer shape of the other.

(Fifth Embodiment)

Figure 6B:
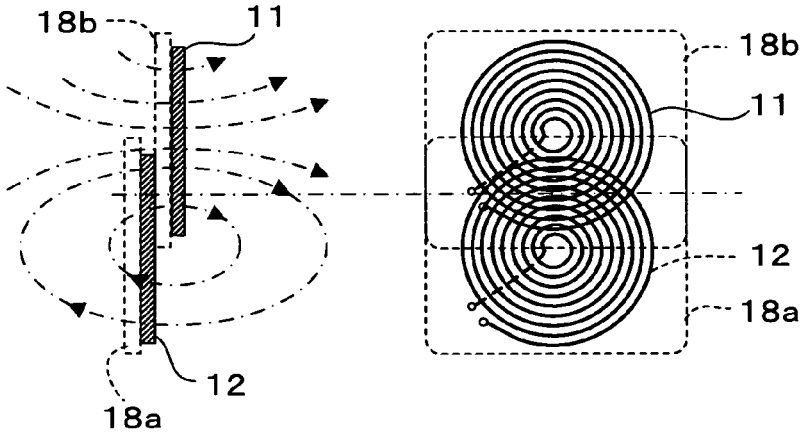

FIG. 6B illustrates a state in which the transmitter coil 11 and the receiver coil 12 are formed so as to partially overlap in plan view. The figure on the left is a schematic sectional view while the figure on the right is a schematic plan view. The transmitter coil 11 is formed on a surface of the insulating substrate 18*b* while the receiver coil 12 is formed on a surface of the insulating substrate 18*a*. The forming method is similar to that in the fourth embodiment. As illustrated in the figure on the left, some of the magnetic lines of force which are linked with the receiver coil 12 are clockwise while others are counterclockwise. This means that, by appropriately setting the overlapped area of the transmitter coil 11 and the receiver coil 12, the induced electromotive force may be made to be 0 V. Therefore, offset setting and the circuit structure may be simplified. Note that, the transmitter coil 11 and the receiver coil 12 are interchangeable and the outer shape of one of the transmitter coil 11 and the receiver coil 12 may be formed so as to be larger than the outer shape of the other.

(Sixth Embodiment)

Figure 6C:
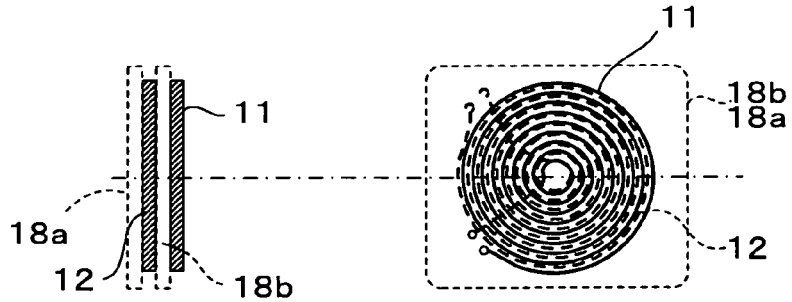

FIG. 6C illustrates a state in which the transmitter coil 11 and the receiver coil 12 are formed so as to overlap in plan view. The figure on the left is a schematic sectional view while the figure on the right is a schematic plan view. The transmitter coil 11 is formed on a surface of the insulating substrate 18*b* while the receiver coil 12 is formed on a surface of the insulating substrate 18*a*. The outer shape of the transmitter coil 11 and the outer shape of the receiver coil 12 are the same and the two coils are concentric. This may make smaller the outer shape of the detecting portion 10, and thus, enables a compact structure of the pressure damper 1. Note that, the receiver coil 12 and the transmitter coil 11 are interchangeable and the outer shape of one of the transmitter coil 11 and the receiver coil 12 may be formed so as to be larger than the outer shape of the other.

(Seventh Embodiment)

Figure 6D:
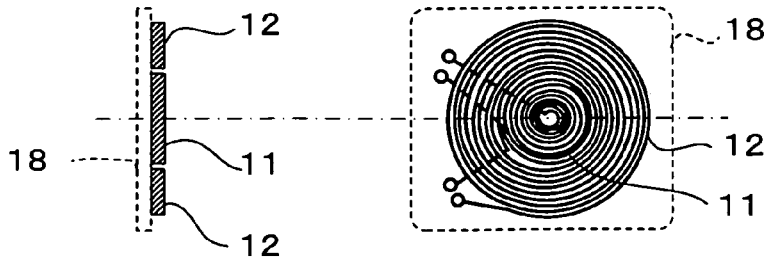

FIG. 6D illustrates a state in which the transmitter coil 11 and the receiver coil 12 are formed on a same surface and the transmitter coil 11 is formed inside the receiver coil 12. The figure on the left is a schematic sectional view while the figure on the right is a schematic plan view. The transmitter coil 11 and the receiver coil 12 are formed on a same surface of the insulating substrate 18, and two electrode terminals of the transmitter coil 11 and an electrode terminal on a center side of the receiver coil 12 are routed to a rear surface side via a through hole formed in the insulating substrate 18. This enables coils of a single-layer structure and of a compact size. The receiver coil 12 and the transmitter coil 11 are interchangeable.

As described above, there are various kinds of variations in the structure of the transmitter coil 11 and the receiver coil 12, and an appropriate one may be selected according to the purpose of use. Further, in the above-mentioned embodiments, by forming a conductive film on an insulating substrate and carrying out photolithography and etching, spiral coils are formed. However, the present invention is not limited thereto. The coils may be polygonal coils such as rectangular coils or hexagonal coils, and may be coils formed by winding wire.

(Eighth Embodiment)

Figure 7:
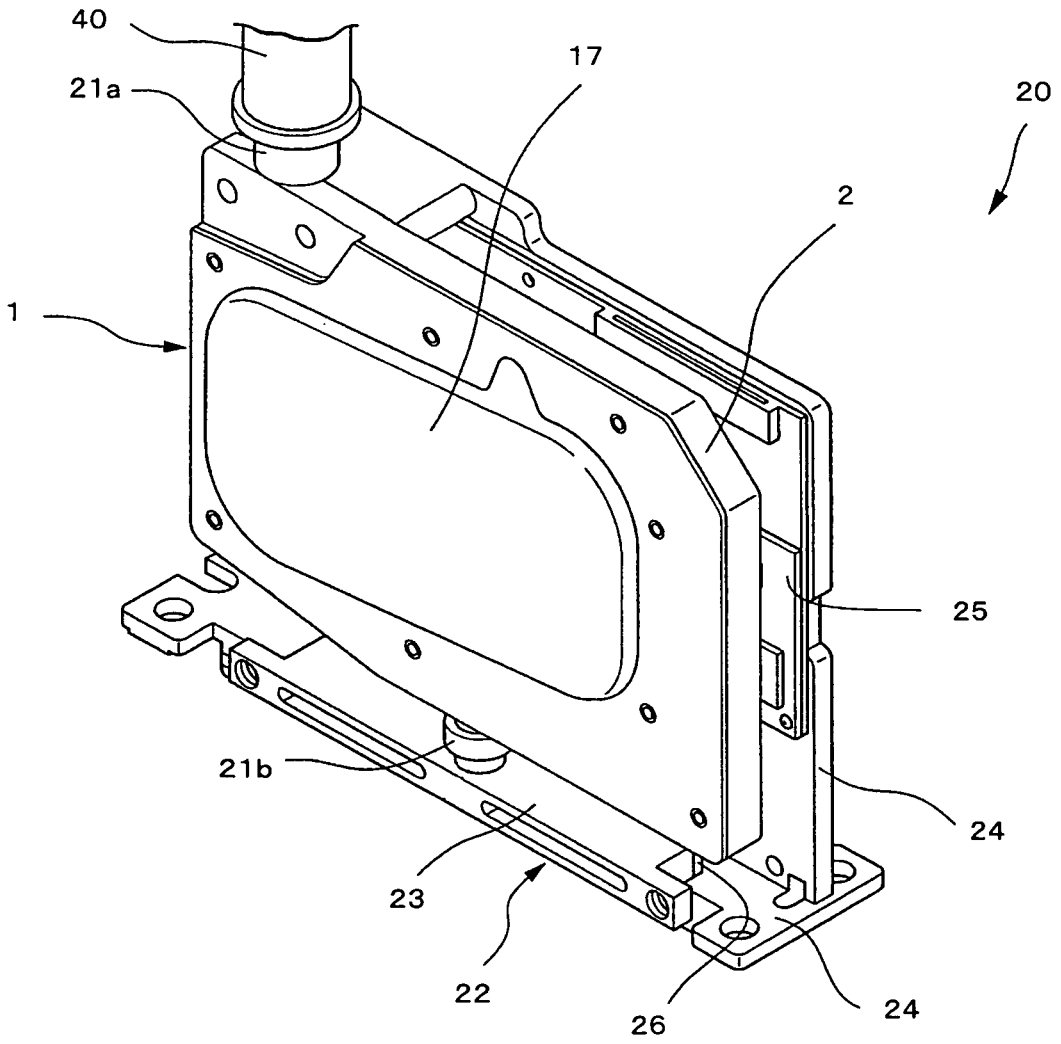
FIG. 7 is a perspective view of a liquid jet head according to an eighth embodiment of the present invention.
Figure 8:
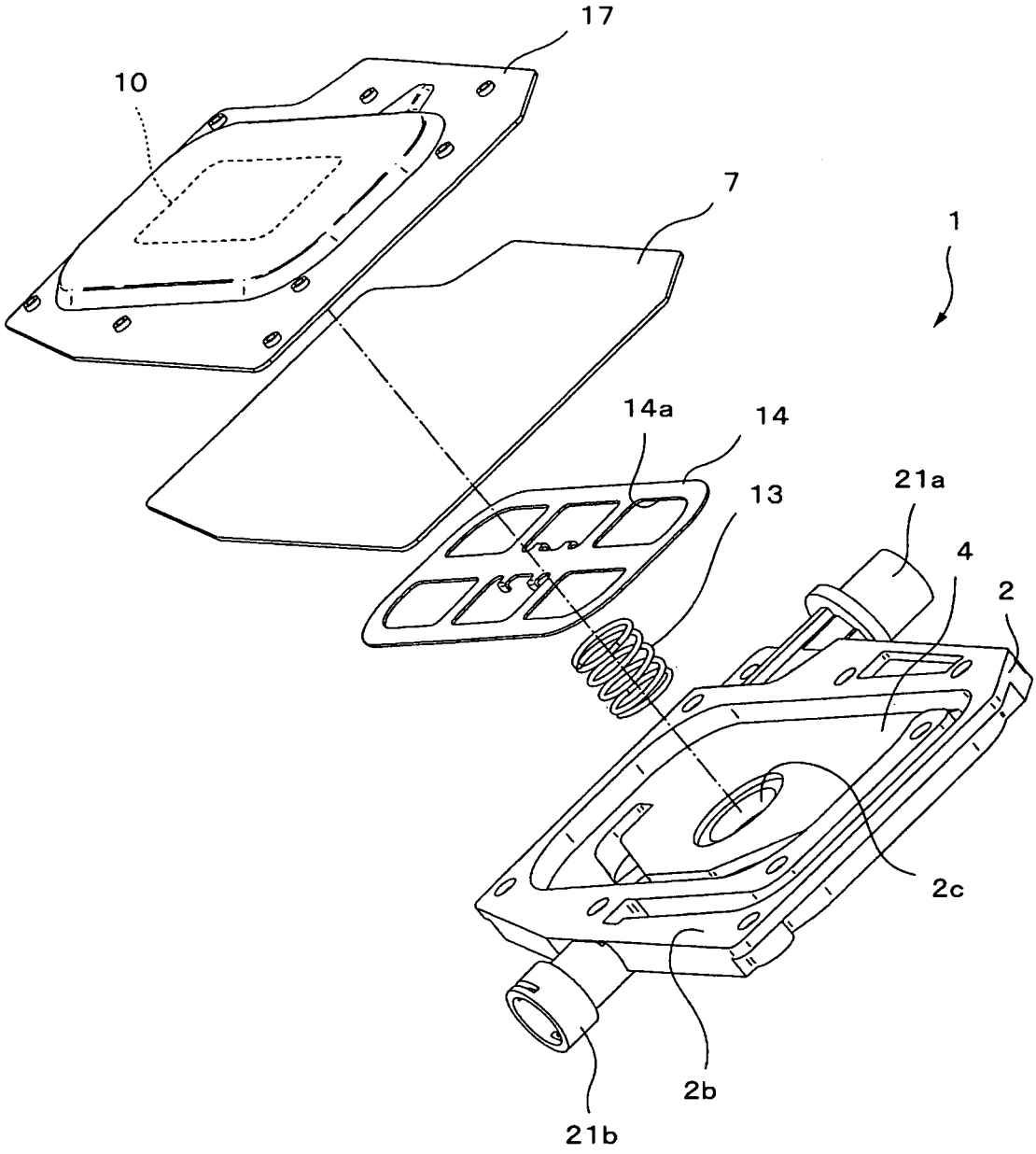
FIG. 8 is an exploded perspective view of a pressure damper according to the eighth embodiment of the present invention.

FIG. 7 and FIG. 8 are explanatory diagrams illustrating a liquid jet head 20 according to an eighth embodiment of the present invention. FIG. 7 is a perspective view of the liquid jet head 20 while FIG. 8 is an exploded perspective view of the pressure damper 1 used in the liquid jet head 20. Like reference symbols are used to designate like members or members having like functions.

As illustrated in FIG. 7, the liquid jet head 20 includes a base 24, a jetting portion 22 for discharging liquid droplets on a recording medium (not shown), the pressure damper 1 for supplying liquid to the jetting portion 22, and a control circuit board 25 having a control circuit mounted thereon, which controls the jetting portion 22 and processes a detection signal received from the pressure damper 1. The jetting portion 22 includes an actuator 26 for causing liquid droplets to be discharged according to a drive signal, a flow path member 23 for supplying liquid to the actuator 26, and a flexible circuit board (not shown) which electrically connects the actuator 26 and the control circuit board 25. The base 24 is in the shape of a screen, and the actuator 26 is mounted on a bottom portion thereof while the control circuit board 25 and the pressure damper 1 are fixed to side surfaces thereof. The pressure damper 1 is fixed to the base 24 so that the cover 17 is on the outside and the main body portion 2 faces the base 24.

Liquid flows from a supply tube 40 via a connecting portion 21*a* into the main body portion 2 of the pressure damper 1, and further flows via a connecting portion 21*b* into the flow path member 23 and further into the actuator 26. The actuator 26 causes a liquid droplet to be discharged toward a recording medium (not shown) below according to a drive signal from the control circuit. Here, as the pressure damper 1, the pressure dampers 1 according to the first to seventh embodiments may be used.

The pressure damper 1 reduces pressure fluctuations of liquid which flows in, and detects and sends to the control circuit the pressure of the liquid. Further, the pressure damper 1 is placed close to the actuator 26 of the liquid jet head 20, and thus, liquid the pressure fluctuations of which are reduced may be supplied to the actuator 26, and the actual pressure fluctuations close to the nozzles may be detected. Therefore, pressure of liquid when a liquid droplet is discharged may be controlled with high precision.

As illustrated in FIG. 8, the pressure damper 1 includes the main body portion 2 having the recessed portion 4, the connecting portion 21*a* for incoming liquid, and the connecting portion 21*b* for outgoing liquid, the flexible thin film 7 placed over an upper surface 2*b* of the recessed portion 4, for closing the opening of the recessed portion 4, and the cover 17 having the detecting portion 10 placed on an inner surface thereof.

The reference member 14 is engaged with the recessed portion 4 side of the flexible thin film 7. The elastic member 13 including a coil spring is placed between the reference member 14 and a recess 2*c* formed in a bottom surface of the recessed portion 4. One end of the elastic member 13 is engaged with the reference member 14 while the other end of the elastic member 13 is engaged with the recess 2*c* to urge the reference member 14 toward the flexible thin film 7. The flexible thin film 7 changes its position almost as a free end in a direction of a normal to a surface of fluid, and thus, may have the function of reducing pressure fluctuations when the pressure of fluid suddenly changes. Further, the position of the flexible thin film is a point at which the internal pressure of fluid, the outside atmospheric pressure, the urging force (resilience) of the elastic member 13, and the like are in equilibrium, and thus, the pressure of fluid may be determined from the position. Further, the elastic member 13 is placed between the flexible thin film 7 and the main body portion 2, and thus, when the pressure in the recessed portion 4 becomes negative, the flexible thin film 7 is prevented from bending inside the recessed portion 4 to close the connecting portions 21*a* and 21*b* and blocking communication of liquid between the inside of the recessed portion 4 and the external regions.

(Ninth Embodiment)

Figure 9:
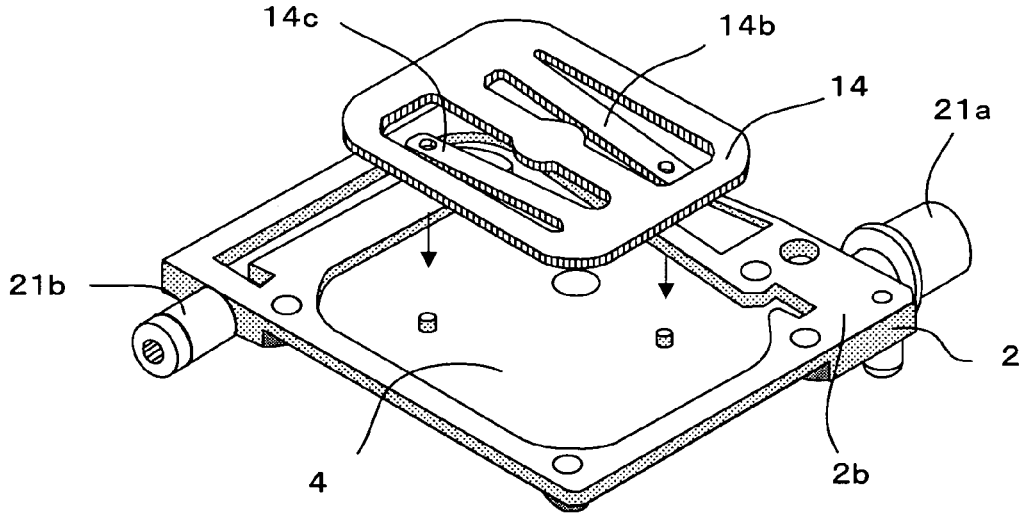
FIG. 9 is a partial exploded perspective view of a pressure damper according to a ninth embodiment of the present invention.

FIG. 9 is a partial exploded perspective view for describing the pressure damper 1 according to a ninth embodiment of the present invention, and illustrates only the main body portion 2 and the reference member 14. The pressure damper 1 differs from the pressure damper 1 illustrated in FIG. 8 in that the elastic member 13 and the reference member 14 are made of a same material and are integral, and portions which correspond to the elastic member 13 are leaf springs of inclined portions 14*b*. Other structures are similar to those illustrated in FIG. 8. In the first to third and eighth embodiments described above, the reference member 14 and the elastic member 13 are separate members, but the present invention is not limited thereto. In other words, the reference member 14 and the elastic member 13 may be an integral member. More specifically, as illustrated in FIG. 9, the inclined portions 14*b* of the reference member 14 may be inclined from the flexible thin film side to the recessed portion 4 side and tip portions 14*c* of the inclined portions 14*b* may be provided so as to be freely brought into/out of contact with the recessed portion 4. The tip portions 14*c* are not fixed to the recessed portion 4, and the inclined portions 14*b* has the function of the elastic member 13 described above with its resilience. In this case, the inclined portions 14*b* are urged so that the tip portions 14*c* are always in contact with the recessed portion 4 and so that the reference member 14 is always in contact with the flexible thin film.

As described above, as the reference member 14, a conductive material such as a metal or a magnetic material may be used. A portion to be detected of the reference member 14 is formed so as to be larger than the outer shapes of the transmitter coil 11 and the receiver coil 12 which are placed on the corresponding detecting portion 10. This is for the purpose of causing many of the magnetic lines of force generated by the transmitter coil 11 to pass through the reference member 14.

(Tenth Embodiment)

Figure 10:
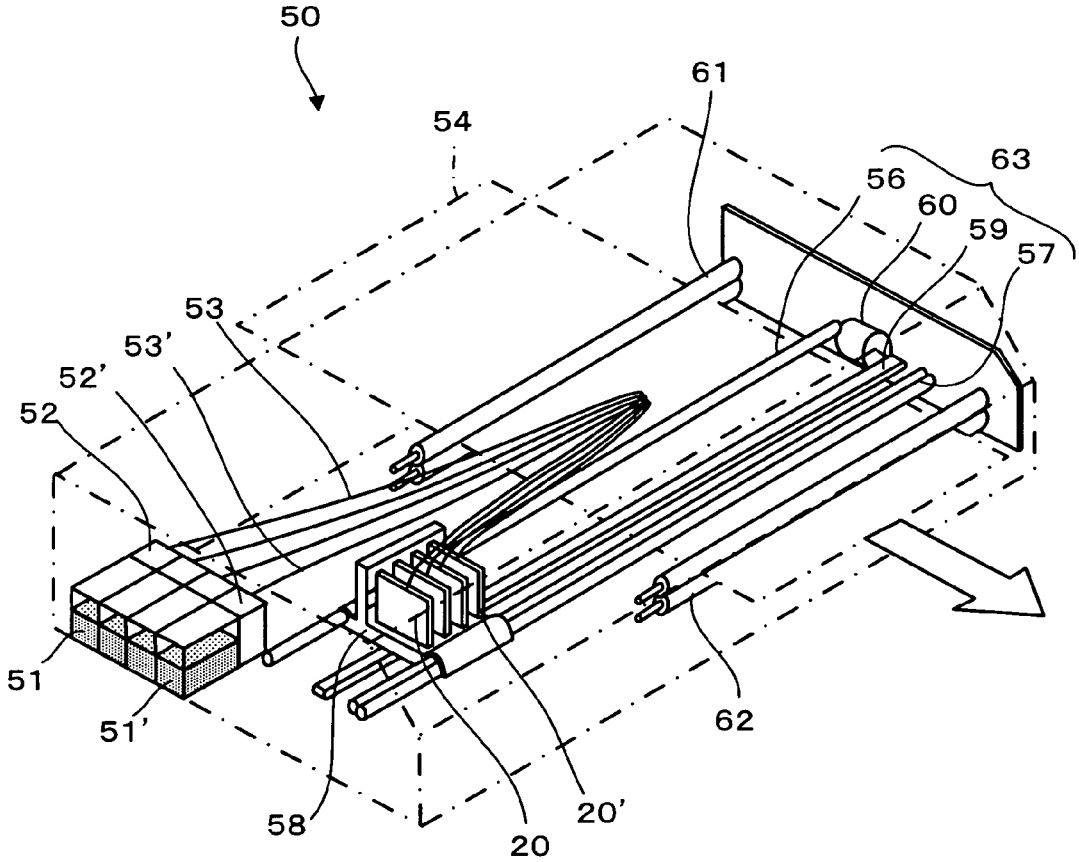
FIG. 10 is a schematic perspective view of a liquid jet apparatus according to a tenth embodiment of the present invention.

FIG. 10 is a schematic perspective view of a liquid jet apparatus 50 according to a tenth embodiment of the present invention. The liquid jet apparatus 50 uses the liquid jet head 20 described in the above-mentioned eighth embodiment. The liquid jet apparatus 50 includes a moving mechanism 63 for reciprocating liquid jet heads 20 and 20', liquid supply tubes 53 and 53' for supplying liquid to the liquid jet heads 20 and 20', and liquid tanks 51 and 51' for supplying liquid to the liquid supply tubes 53 and 53'. Each of the liquid jet heads 20 and 20' includes the actuator 26 for causing liquid to be discharged, the flow path member 23 for supplying liquid to the actuator 26, and the pressure damper 1 for supplying liquid to the flow path member 23.

Here, the pressure damper 1 not only suppresses pressure fluctuations of liquid supplied to the flow path member 23 and further to the actuator 26 but also detects pressure fluctuations of the liquid, generates a detection signal, and sends the detection signal to a control portion (not shown) of the liquid jet apparatus 50. The control portion regulates the pressure of liquid to be supplied to the actuator 26 based on the detection signal.

Specific description is made in the following. The liquid jet apparatus 50 includes a pair of transfer means 61 and 62 for transferring a recording medium 54 such as paper in a main scan direction, the liquid jet heads 20 and 20' for discharging liquid toward the recording medium 54, pumps 52 and 52' for pumping liquid stored in liquid tanks 51 and 51' into the liquid supply tubes 53 and 53' and the moving mechanism 63 or the like for causing the liquid jet head 20 and 20' to scan in an auxiliary scan direction which is perpendicular to the main scan direction.

Each of the pair of transfer means 61 and 62 includes a grid roller and a pinch roller which extend in the auxiliary scan direction and which rotate with roller surfaces thereof being in contact with each other. A motor (not shown) axially rotates the grid rollers and the pinch rollers to transfer in the main scan direction the recording medium 54 sandwiched therebetween. The moving mechanism 63 includes a pair of guide rails 56 and 57 which extend in the auxiliary scan direction, a carriage unit 58 which is slidable along the pair of guide rails 56 and 57, an endless belt 59 which is coupled to the carriage unit 58 for moving the carriage unit 58 in the auxiliary scan direction, and a motor 60 for rotating the endless belt 59 via a pulley (not shown).

The carriage unit 58 includes a plurality of liquid jet heads 20 and 20' mounted thereon for discharging, for example, four kinds of liquid droplets: yellow; magenta; cyan; and black. The liquid tanks 51 and 51' store liquid of corresponding colors, and supply the liquid via the pumps 52 and 52' and the liquid supply tubes 53 and 53' to the liquid jet heads 20 and 20'.

The control portion of the liquid jet apparatus 50 gives a drive signal to respective liquid jet heads 20 and 20' to cause liquid droplets of respective colors to be discharged. The control portion controls discharge timing of liquid from the liquid jet heads 20 and 20', rotation of the motor 60 for driving the carriage unit 58, and transfer speed of the recording medium 54 to perform recording of an arbitrary pattern on the recording medium 54. Further, the control portion controls the pumps 52 and 52' based on the detection signal of the pressure damper 1 to regulate the pressure of liquid to be supplied to the actuator 26. For example, when the control portion determines from the detection signal of the pressure damper 1 that the pressure of liquid is higher than a reference value, the control portion controls the pumps 52 and 52' to decrease the pressure of liquid to be supplied. When the control portion determines from the detection signal of the pressure damper 1 that the pressure of liquid is lower than the reference value, the control portion controls the pumps 52 and 52' to increase the pressure of liquid to be supplied. This enables the pressure of liquid in the actuator 26 to be set at a predetermined value, and the discharge speed of a liquid droplet discharged from a nozzle and a meniscus of liquid in a nozzle to be constant.

In the embodiments described above, the pressure damper 1 is placed in close vicinity to the actuator 26, and thus, even if the apparatus becomes larger and the recording speed of the apparatus becomes higher, and the liquid supply tube 53 becomes longer, the pressure fluctuations of liquid in the actuator 26 may be effectively reduced, and the pressure fluctuations of liquid may be detected close to the actuator 26 to exert feedback control over the pump 52, and thus, the pressure of liquid in the actuator 26 may be controlled with high precision.

What is claimed is:

1. A pressure damper comprising:

a main body portion having a recessed portion with an opening and a communication hole that opens to an inner surface of the recessed portion and communicates to an external region;

a flexible thin film closing the opening of the main body portion for reducing pressure fluctuations of fluid in the recessed portion; and a detecting portion engaged with the main body portion for detecting electromotive force generated by electromagnetic induction to thereby detect a relative positional change between the flexible thin film and the main body portion.

2. A pressure damper according to claim 1, further comprising an elastic member one end of which is engaged with the flexible thin film and the other end of which is engaged with the main body portion.

3. A pressure damper according to claim 1, further comprising: a cover placed on the main body portion so as to cover the flexible thin film; wherein the detecting portion is placed on the flexible thin film side of the cover, and the detecting portion and the main body portion engage with each other via the cover.

4. A pressure damper according to claim 1, wherein the detecting portion detects a positional change of the flexible thin film as a change in the electromotive force generated by electromagnetic induction.

5. A pressure damper according to claim 1, further comprising a transmitter coil that is placed on one of the detecting portion and the flexible thin film and that receives from the detecting portion an alternating current to generate a magnetic field, and a receiver coil that is placed on the other of the detecting portion and the flexible thin film and that induces the electromotive force by the magnetic field.

6. A pressure damper according to claim 1, wherein the detecting portion comprises a transmitter coil for generating magnetic lines of force and a receiver coil for inducing electromotive force.

7. A pressure damper according to claim 6, wherein each of the transmitter coil and the receiver coil has a planar shape, the transmitter coil and the receiver coil being stacked relative to one another so as to partially overlap in plan view.

8. A pressure damper according to claim 6, wherein each of the transmitter coil and the receiver coil has a planar shape, the transmitter coil and the receiver coil being positioned so as not to overlap relative one another in plan view.

9. A pressure damper according to claim 6, wherein the detecting portion further comprises an insulating substrate on which the transmitter coil and the receiver coil are mounted.

10. A pressure damper according to claim 6, wherein the detecting portion further comprises a magnetic layer having a high magnetic permeability, the magnetic layer being disposed on an opposite side of the flexible thin film with respect to the transmitter coil and the receiver coil.

11. A pressure damper according to claim 6, wherein each of the transmitter coil and the receiver coil has a planar shape, the transmitter coil and the receiver coil being stacked relative one another so as to be concentric in plan view.

12. A pressure damper according to claim 11, wherein the transmitter coil has an outer shape that is the same as an outer shape of the receiver coil.

13. A pressure damper according to claim 6, wherein the detecting portion further comprises a transmitter circuit for transmitting to the transmitter coil a signal for detecting a position, and a receiver circuit for generating from a signal received by the receiver coil a detection signal representing a relative positional change.

14. A pressure damper according to claim 13, wherein the receiver circuit comprises an offset regulating portion for regulating an offset of a received signal and a gain regulating portion for regulating a gain in amplifying a received signal.

15. A pressure damper according to claim 14, wherein the detecting portion comprises a storing portion for storing set values of the offset and the gain of the received signal.

16. A pressure damper according to claim 1, further comprising a reference member engaged with the flexible thin film, the reference member member being made of one of a conductive material and a magnetic material.

17. A pressure damper according to claim 16, wherein each of the transmitter coil and the receiver coil has a planar shape and is disposed parallel to one another, and an outer shape of the reference member being larger than the outer shapes of the transmitter coil and the receiver coil viewed from a direction of a normal to a plane of the planar shapes.

18. A pressure damper according to claim 16, wherein an elastic member is connected between the reference member and the main body portion.

19. A pressure damper according to claim 18, wherein the reference member and the elastic member are formed as one integral member.

20. A pressure damper according to claim 16, further comprising a position regulating portion for regulating a positional relationship between the reference member and the main body portion.

21. A pressure damper according to claim 20, wherein the position regulating portion is placed between an elastic member and the main body portion.

22. A liquid jet head, comprising:

the pressure damper according to claim 1;

a tube communicating to the communication hole of the pressure damper; and an actuator for causing liquid flowing in from the tube to be discharged.

23. A liquid jet apparatus, comprising:

the liquid jet head according to claim 22;

a tank for storing the liquid and supplying the liquid to the tube; and a pump for controlling a pressure of the liquid based on the relative positional change detected by the pressure damper.

* * * * *